United States Patent [19]

Bottum, Jr. et al.

[11] Patent Number: 4,823,557

[45] Date of Patent: Apr. 25, 1989

[54] DEHUMIDIFIER WATER HEATER STRUCTURE AND METHOD

[76] Inventors: Edward W. Bottum, Jr.; Edward W. Bottum, both of 9357 Spenser Rd., Brighton, Mich. 48116

[21] Appl. No.: 117,044

[22] Filed: Nov. 5, 1987

[51] Int. Cl.[4] ..... F25B 27/02

[52] U.S. Cl. ..... 62/238.6; 62/271; 62/513

[58] Field of Search ..... 62/271, 238.6, 238.7, 62/79, 80, 160, 324.5, 513; 237/2 B

[56] References Cited

U.S. PATENT DOCUMENTS 4,513,585 4/1985 Maisonneuve ..... 62/238.6

4,727,727 3/1988 Reedy ..... 62/238.6

*Primary Examiner*—Henry A. Bennet

*Attorney, Agent, or Firm*—Dale R. Small & Associates

[57] ABSTRACT

Dehumidifier water heater structure and method. The structure includes an outer, air permeable enclosure and a vertical stack positioned centrally thereof, a heat pump circuit including a compressor centrally of the enclosure, a condenser heat exchanger, within and extending axially of the vertical stack, an expansion device connected to the bottom of the condensor heat exchanger and an evaporator coil within the enclosure surrounding the compressor and connected between the compressor and expansion device. A fan for forcing air form the enclosure through the stack, insulation surrounding the condenser heat exchanger and a pump for passing water to be heated through the condenser heat exchanger may also be provided. In the method, the air to be dehumidified is passed through the enclosure so that moisture in the air will condense on the evaporator and dehumidified air is passed out of the stack by convection or may be assisted by a fan while water to be heated is passed upwardly through the condenser heat exchanger due to the thermal siphon principal or may be pumped. In another embodiment of the invention, the temperature of the evaporator is selectively varied above and below the dew point of the ambient air by varying the air flow over the evaporator or the refrigerant flow through the evaporator as by parallel expansion devices, one of which is selectively closeable to selectively provide a dehumidifier water heater or a heat pump water heater.

38 Claims, 2 Drawing Sheets

FIG. 1
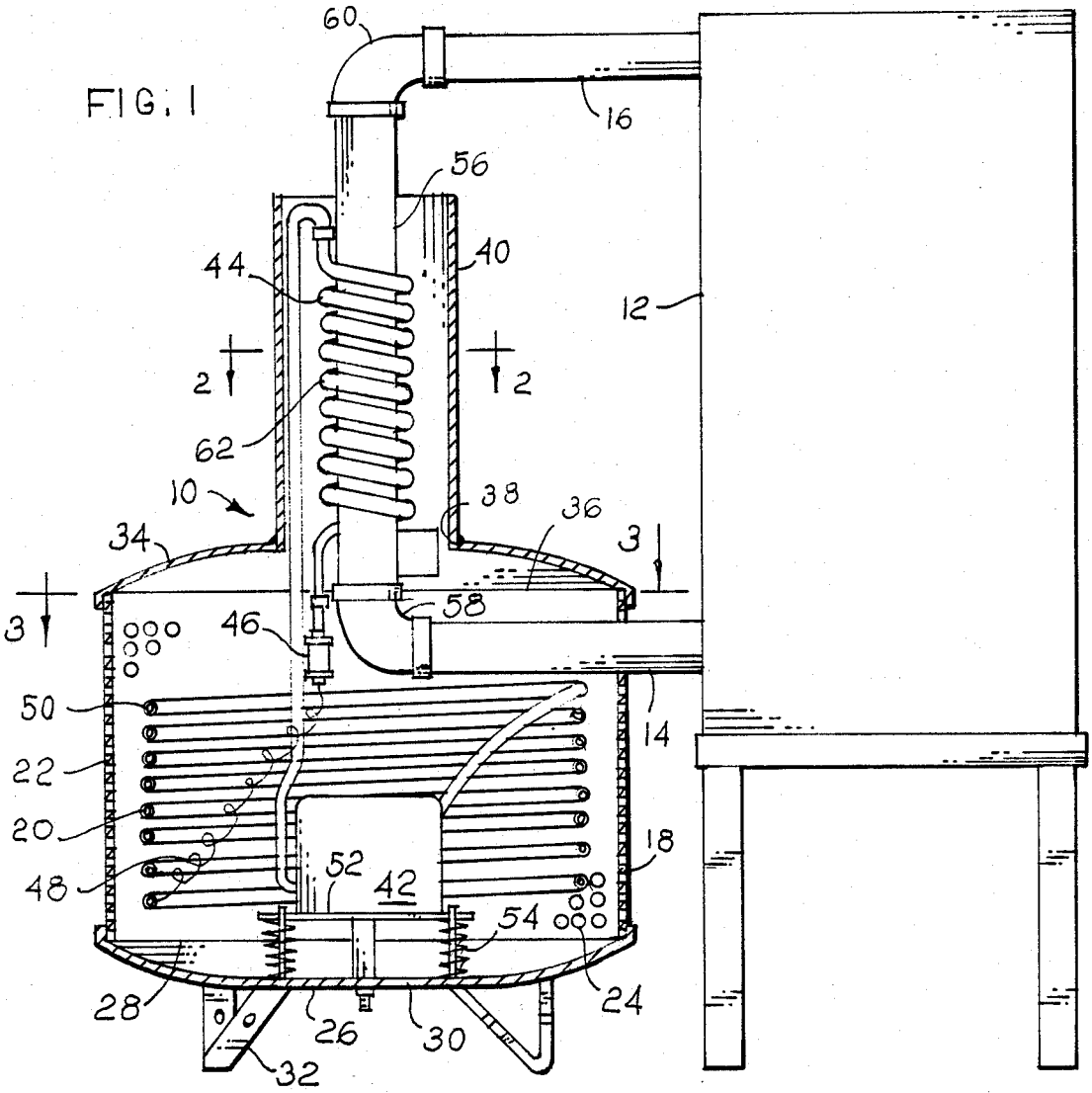
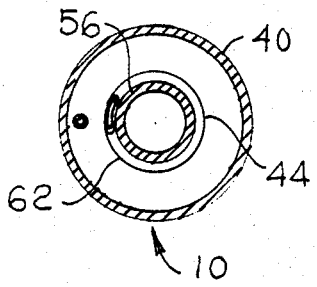
FIG. 2
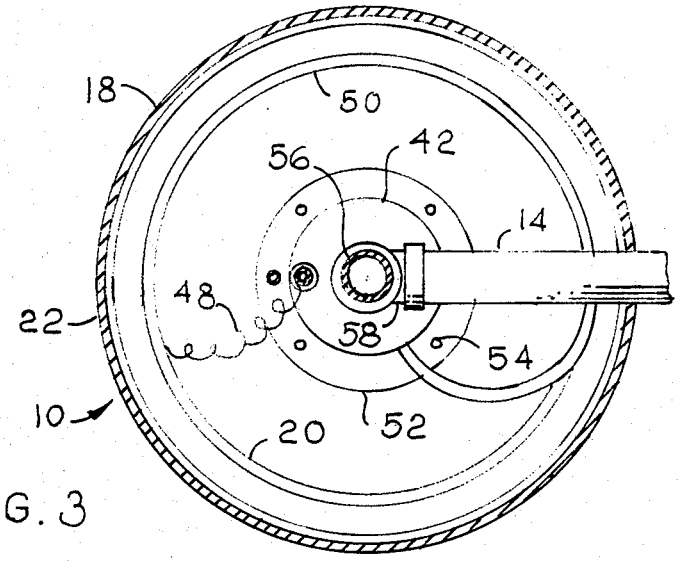
FIG. 3

FIG. 4
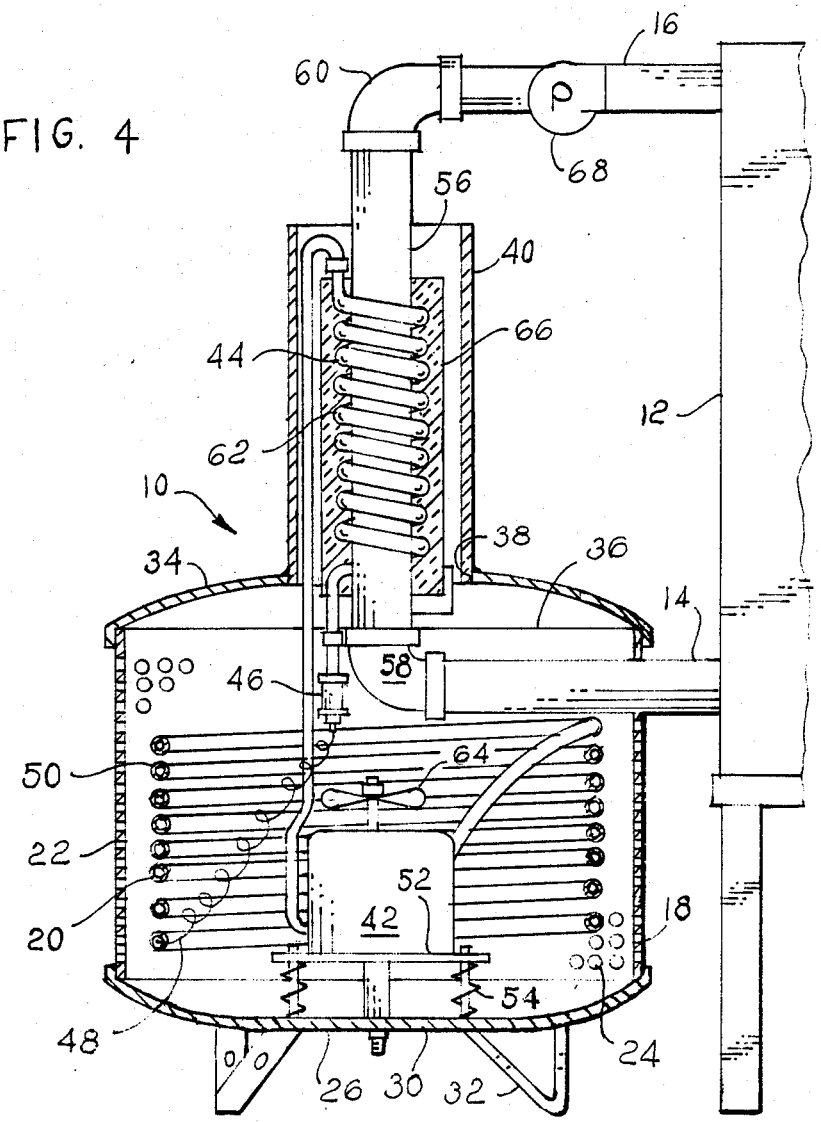
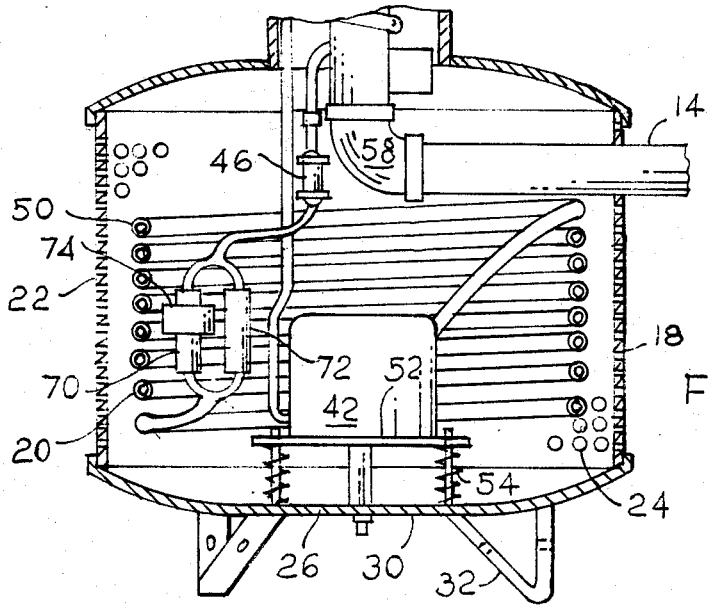
FIG. 5

DEHUMIDIFIER WATER HEATER STRUCTURE AND METHOD

BACKGROUND OF THE INVENTION

1. Field of the Invention

The invention relates to dehumidifiers and water heaters and refers more specifically to a combined dehumidifier water heater utilizing a heat pump circuit wherein air and water are passed through the dehumidifier water heater by a thermal siphon principal to provide an extremely efficient combined dehumidifier water heater which may readily be converted from a dehumidifying water heater to a heat pump water heater.

2. Description of the Prior Art

In the past, dehumidifiers and water heats have usually been provided separately. Thus, dehumidifiers of the past wherein they have utilized heat pump systems have produced heat during the dehumidifying of the air passed therethrough and have wasted the heat with consequent lower then necessary efficiency considering energy in and desired output of the dehumidifier. Similarly, water heaters of the past wherein they have utilized a heat pump to heat by means of a combined condenser heat exchanger have not utilized the cooling properties of the heat pump evaportor. Rapid conversion of a dehumidifier water heater into a heat pump heater or the reverse of such conversion in accordance with dehumidifying requirements is not believed to have been known in the past.

Further, in addition to not being combined, dehumidifiers and water heaters of the past have not generally utilized the thermal siphon principal to pass air therethrough to be dehumidified and to pass water therethrough to be heated. The efficiency of prior dehumidifiers and water heaters has for this reason also been less than possible.

Further, in addition to not being combined, dehumidifiers and water heaters of the past have not generally utilized the thermal siphon principal to pass air therethrough to be dehumidified and to pass water therethrough to be heated. The efficiency of prior dehumidifiers and water heaters has for this reason also been less than desireable and less than possible.

SUMMARY OF THE INVENTION

The invention comprises unique heat pump structure for the combined purpose of dehumidifying air and at the same time heating water or, when dehumidifying is not required, for heating water only. Since energy used by the heat pump accomplishes both purposes and since the performance coefficient of the heat pump alone can run 2.5 or 3 to 1 it is evident that an appreciable savings in energy is realized when utilizing the structure of the invention in accordance with the method of the invention.

A refrigeration compressor, condenser heat exchanger combination, expansion device and evaporator connected in series in a heat pump circuit are required for the structure of the invention together with an enclosure for the heat pump circuit which is connected to a hot water storage tank. A condenser fan and a water pump are optional in the convention. For converting between a dehumidifying water heater and a heat pump water heater in accordance with dehumidifying requirements means are provided to increase the evaporator temperature to a temperature above the dew point of the combined air.

In accordance with the method of the invention, air is heated in the dehumidifier water heater and thus caused to pass over the evaporator whereby moisture in the air condenses on the evaporator and the air is thus dehumidified by convection while water to be heated is caused to pass through the condenser heat exchanger combination in accordance with the thermal siphon principal to absorb heat from the condenser portion of the combined condenser heat exchanger. Alternatively, air may be drawn across the evaporator by means of a fan or the like and water may be pumped through the heat exchanger portion of the combined condenser heat exchanger.

In accordance with the method of the invention, air is heated in the dehumidifier water heater and thus caused to pass over the evaporator whereby moisture in the air condenses on the evaporator and the air is thus dehumidified by convection while water to be heated is caused to pass through the condenser heat exchanger combination in accordance with the thermal siphon principal to absorb heat form the condenser portion of the combined condenser that exchanger. Alternatively, air may be drawn across the evaporator by means of a fan or the like and water may be pumped through the heat exchanger portion of the combined condenser heat exchange.

When dehumidifying is undesired, as in the winter months, in accordance with the method of the invention, the evaporator temperature is increased so that it is above the dew point of the ambient air so that moisture is not condensed out of the air while sensible heat is removed from the air. This is accomplished in accordance with the method of the invention for example by increasing the air flow through the evaporator coil or closing one of two parallel expansion devices in the past heat pump system.

BRIEF DESCRIPTION OF THE DRAWINGS

FIG. 1 is a partial longitudinal section view of a combined dehumidifier water heater constructed in accordance with the invention.

FIG. 2 is a cross section of the dehumidifier water heater illustrated in FIG. 1 taken substantially on the lines 2—2 in FIG. 1.

FIG. 3 is a cross section of the dehumidifier water heater illustrated in FIG. 1 taken substantially on line 3—3 of FIG. 1.

FIG. 4 is a partial longitudinal section view of a modification of the dehumidifier water heater illustrated in FIG. 1.

FIG. 5 is a partial longitudinal section view of another embodiment of the dehumidifier water heater of the invention including structure permitting rapid conversion of the structure between a dehumidifying water heater and a heat pump water heater.

DESCRIPTION OF THE PREFERRED EMBODIMENT

As shown best in FIG. 1, the dehumidifier water heater structure 10 is connected to a water storage tank 12 by water pipes 14 and 16.

The dehumidifier water heater 10 includes an outer enclosure 18 and a heat pump circuit 20 within the outer enclosure.

The outer enclosure 18 includes a cylindrical casing 22 which has a plurality of openings 24 therethrough for permitting air movement from the outside to the inside thereof. The casing 22 may be for example a grill or a circular louver structure.

A bottom closure 26 shaped as shown best in FIG. 1, is provided over the lower end 28 of the cylindrical casing 22 and has an opening 30 in the bottom thereof through which condensate collected from the evaporator 50 of the heat pump circuit 20 may be removed from the dehumidifier water heater structure 10.

Again, as shown in FIG. 1, leg members in the form of V-shaped metal straps 32 may be secured to the bottom closure 26 by convenient means such as welding or the like to support the dehumidifier water heater structure 10. As shown three such leg members 32 are provided on the dehumidifier water heater structure 10 spaced angularly about the axis of generation of the casing 22 by approximately 120°.

The upper closure 34 provided over the top 36 of the cylindrical casing 22 has an opening 38 centrally thereof. Opening 38 receives the stack 40 of the outer enclosure 18 centrally thereof. The stack 40 may be welded to the upper closure 34 around the opening 38 therein and is cylindrical as shown best in FIG. 2.

The heat pump circuit 20 includes a compressor 42, a combination condenser heat exchanger 44, refrigerant dryer 46, capillary tube expansion device 48 and helical coil evaporator 50. As will be understood by those in the art, the heat pump 20 is charged with a phase change refrigerant such as freon or the like.

As shown, the compressor 42 is an electric motor driven compressor and in the embodiment of the dehumidifier water heater 10 illustrated in FIG. 1 requires the only energy input to the dehumidifier water heater. The compressor 42 is resiliently mounted on the plate 52 from the bottom closure 26 by the spring and shaft structures 54. Vibration and noise in operation of the dehumidifier water heater 10 is reduced by the resilient mounting of the compressor 42.

As show, the condenser heat exchanger includes a substantially straight water pipe section 56 which is connected at its opposite ends through 90° couplings 58 and 60 to the water pipes 14 and 16 from the water storage tank 12. The condenser heat exchanger 44 further includes the helically wound copper tube 62 in intimate heat transfer relation to the water pipe 56. The water pipe 56 and the helically wound coil 62 thus provide a double wall heat exchanger.

In constructing the condenser heat exchanger 44 an annealed cooper tube which is soft is first wound around a mandrel into the helical shape shown during which winding it is flattened. The flattened helical wound tube is then tacked at each end to the straight section of water pipe 56 and the tube 62 is then hydraulically expanded into intimate heat transfer relation with the section of water pipe 56.

The combination condenser heat exchanger shown in FIG. 1 is thus a double wall type heat exchanger. It will be understood that the condenser heat exchanger 44 could be of single wall construction. The double wall heat exchanger shown makes a leak of refrigerant into potable water most unlikely. A single wall heat exchanger would provide slightly greater efficiency.

As shown, the expansion device 48 is a capillary tube. It will be understood that other types of expansion devices such as expansion valves may be utilized in the heat pump circuit 20 within the scope of the invention.

The evaporator 50 as shown is a helical coil wound on a large diameter. The evaporator coil 50 may be constructed of either finned or prime surface tubing.

In overall operation of the dehumidifier water heater structure 10 as shown in FIG. 1 in accordance with the method of the invention, the compressor 42 compresses gaseous refrigerant received from the evaporator coil 50 and passes it through the top of the helical coil 62 of the condenser heat exchanger 44. The compressed refrigerant is condensed in the helical coil 44 and in condensing gives up heat to the helical coil 44 which is transferred to the water piper 56 and subsequently to the water in the water pipe 56.

In the embodiment of the invention shown in FIG. 1, the water flows upwardly through the water pipe 56 due to the thermal siphon effect causing heated water to rise. Cooler water is thus passed to the bottom of the water pipe 56 from the bottom of the water storage tank 12 where it is heated in the pipe 56 and then returned to the water storage tank 12 in a heated condition through the pipe 16.

The condensed refrigerant passes through the refrigerant drying 46 and then through the capillary tube 48. The refrigerant from the capillary tube 48 then expands into the evaporator coil 50. The refrigerant boils and cools below the dew point. The evaporator coil is thus cooled below the dew point and room air which is in contact with the evaporator coil 50 is caused to condense on the cold evaporator coil 50. Ultimately, the moisture condensed on the evaporator coil 50 drips off and passes out of the bottom closure 26 through the opening 30 therein.

Since the compressor 42 is quite warm, air within the dehumidifier water heater is heated by the compressor and rises through the vertical stack 40. As the heated air rises above the compressor and leaves by convection through the stack 40, replacement room air is drawn into the dehumidifier water heater structure 10 through the air opening 24 in the casing 22 and is dehumidified by the cool evaporator coil.

In the modified combination dehumidifier water heater structure shown in FIG. 4, a small air fan 64 is provided above the compressor 42 to help induce air circulation through the stack 40. When the fan 54 is used, then the combination heat exchanger 44 should have heat insulation 66 as shown in FIG. 4.

If the heat exchanger 44 is not insulated circulation of air will increase. However, shielding the heat exchanger with insulation 66 will increase the efficiency of the heat exchanger 44.

Also, as shown best in FIG. 4, a water pump 68 may be utilized somewhere in the water lines 14, 56 and 16. Such water pump 68 is desirable where the water tank 12 is located a substantial distance from the enclosure 18 and the heat pump circuit 20.

It will be understood by those in the art that by means of the combination dehumidifier water heater structure 10 and method described hereinabove, water is efficiently heated in the storage tank 12 and at the same time air in the room in which the dehumidifier water heater is positioned is dehumidified at an appreciable overall cost savings.

In the embodiment of the invention shown in FIG. 5 the dehumidifier water heater structure 10 of the invention is modified so that it may readily be converted to function either as a dehumidifying water heater or as a heat pump water heater.

This conversion capability of the embodiment dehumidifier of the water heater structure 10 shown in FIG. 5 is particularly useful when the area in the which the structure 10 is installed need not be dehumidified the year round. Thus in some areas dehumidification may be required during the summer months, while actually it is necessary to add moisture to air in the winter months. In the latter case it is an advantage not to have the structure 10 dehumidify when the air is already too dry.

As shown in FIG. 5, the dehumidifier water heater 10 may be readily converted to a heat pump water heater in several ways. Basically, in accordance with the method of the invention, the evaporator temperature is increased by one means or another so that it is at a temperature above the dew point of the ambient air and therefore moisture is not condensed out of the air while sensible heat is removed from the air.

One method by which the evaporator temperature is increased is by increasing the air flow through the evaporator coil. Increasing the air flow through the evaporator coil puts more of a load on the system and causes a rise in suction pressure and suction temperature. The evaporator temperature may thus be raised above the dew point of the ambient air.

The air flow through the evaporator coil may be increased by opening a damper to let more air through or by increasing the blower speed when a blower such as blower 64 is utilized or by using an additional blower.

Another method by which the evaporator temperature may be increased, and perhaps the preferred method, is shown schematically in FIG. 5. In the embodiment of the dehumidifier water heater structure 10, illustrated in FIG. 5, the capillary tube 48 is replaced by two expansion valves 70 and 72 connected in parallel.

With the embodiment of the dehumidifier water heater 10 shown in FIG. 5 when one expansion valve for example, expansion valve 70, is closed and the other expansion valve 72 is open there will be greater resistance to refrigerant flow than when both expansion valves are open and the suction pressure and suction temperature in the evaporator will be reduced below the dew point of the ambient air. The operation of the embodiment of the invention illustrated in FIG. 5 is exactly as considered above with one of the two expansion valves 70 and 72 closed.

However, when it is desired to operate the dehumidifier water heater 10 as a heat pump, water heater, the solinoid valve 74 is caused to permit the flow of refrigerant through the expansion valve 70 in parallel with the expansion valve 72. Therefore at this time there is a much greater total flow through the two expansion valves since they are in parallel with a consequent rise in the suction pressure and temperature in the evaporator 50.

The closing and opening of one of the expansios valves 70 and 72 could also be accomplished by a hand operated valve in the portion of the parallel expansion valve circuit having the controlled expansion valve 70 therein.

Thus it will be readily apparent that the dehumidifier water heater structure 10 of the invention lends itself to operating as a dehumidifier at the same time that it heats water or if desired by operation of a simple switch the dehumidifier water heater structure 10 may be operated as a heat pump water heater without the dehumidification feature.

It will be understood by those in the art that the combined dehumidifier water heater structure 10 and methods described hereinabove, water is efficiently heated in the storage tank 12 and at the same time air in the room in which the dehumidifier water heater is positioned may be dehumidified at an appreciable overall cost savings.

Further, while several embodiments of the present invention have been considered in detail along with possible modifications thereof other embodiments and modifications are contemplated. Thus for example the single capillary tube 48 shown in FIGS. 1, 3 and 4 could be replaced by a single expansion valve. Likewise the two parallel expansion valves shown in FIG. 5 could be replaced by two parallel capillary tubes. It is the intention to include all such embodiments and modifications as are defined by the appended claims within the scope of the invention.

We claim:

1. Dehumidifier water heater structure comprising a compressor, combined condenser heat exchanger, expansion device and evaporator connected in series in a heat pump circuit, means for first circulating the air to be dehumidified around the evaporator to cause the moisture in the air to be dehumidified to condense on the evaporator and second circulating the dehumidified air over the compressor, and mans operably associated with the combined condenser heat exchanger for subsequently passing the dehumidified, heated air out of the dehumidifier water heater structure past the condenser heat exchanger and for circulating material to be heated through the condenser heat exchanger to transfer heat from the condenser heat exchanger into the material to be heated.

2. Structure as set forth in claim 1 wherein the condenser heat exchanger comprises a substantially straight pipe for receiving material to be heated passing therethrough and a helical coil sleeved over and wrapped around the straight pipe in intimate heat transfer relation therewith through which refrigerant in the heat pump circuit is passed to condense therein and give up heat ultimately to the material to be heated.

3. Structure as set forth in claim 2 wherein the helical coil is annealed cooper and is tacked to the ends of the straight pipe hydraulically expanded into the intimate heat transfer relation with the straight pipe.

4. Structure as set forth in claim 1 wherein the evaporation is a helical coil wound on a large diameter and completely surrounds the compressor.

5. Structure as set forth in claim 1 wherein the means for passing air to be dehumidified around the evaportor includes an outer cylindrical enclosure having a plurality of air openings therein, a top and bottom closure and a stack positioned centrally of the top closure, the compressor is positioned centrally of the closure and the condenser heat exchanger is positioned in the stack whereby air entering the enclosure heated by the compressor is passed outwardly through the stack vertically thereof.

6. Structure as set forth in claim 5 and further including a fan positioned within the enclosure for passing air out of the enclosure through the stak.

7. Structure as set forth in claim 6 wherein the condenser heat exchanger is located within the stack and insulation is provided surrounding the condenser heat exchanger.

8. Structure as set forth in claim 7 and further including pump means for pumping material to be heated through the heat exchanger.

9. Structure as set forth in claim 1 and further including means for selectively raising the temperature of the evaporator above the dew point of the ambient air.

10. Structure as set forth in claim 9 wherein the means for raising the temperature of the evaporator comprises means for increasing air flow past the evaporator.

11. Structure as set forth in claim 9 wherein the means for raising the temperature of the evaporator comprises means for increasing the flow of refrigerant therethrough.

12. Dehumidifier water heater structure comprising an outer enclosure including a cylindrical casing having a plurality of air openings therein, a bottom closure over the lower end of the outer casing having an opening therethrough through which condensation may be drained, a top closure over the upper end of the outer casing, a cylindrical stack extending axially through the top closure, a compressor positioned substantially centrally in the cylindrical casing beneath the stack, a condenser heat exchanger positioned within the stack including an inner substantially straight pipe extending axially of the stack and an outer helically wound coil in intimate heat transfer relation with the straight pipe, means connecting the output of the compressor to the top of the helically wound coil of the condenser heat exchanger, a large diameter helically wound evaporator coil within the cylindrical casing surrounding the compressor and in spaced relation to both the cylindrical casing and the compressor, the bottom of which is connected to the expansion device and the top of which is connected to the compressor to complete a heat pump circuit through the compressor, helical coil of the condenser heat exchanger, expansion device and evaporator and a change of phase refrigerant in the heat pump circuit and means for connecting a water storage tank to the straight pipe in the condenser heat exchanger for passing water to be heated through the straight pipe.

13. Structure as set forth in claim 12 and further including a fan positioned within the outer enclosure for passing air out of the enclosure through the stack.

14. Structure as set forth in claim 13 wherein insulation is provided surrounding the condenser heat exchanger.

15. Structure as set forth in claim 12 and further including pump means for pumping material to be heated through the heat exchanger.

16. Structure as set forth in claim 12 wherein the expansion device is a capillary tube.

17. Structure as set forth in claim 12 wherein the expansion device is a parallel circuit of expansion valves.

18. Structure as set forth in claim 17 wherein the expansion device includes means for selectively closing at least one of the expansion valves.

19. The method of dehumidifying air and heating water comprising passing air to be dehumidified into an enclosure including the evaporator and the condenser of a heat pump circuit first past the evaporator to condense the moisture in the air on the evaporator and next past the compresser of the heat pump circuit to be heated and then out of the enclosure past the condenser heat exchanger of the heat pump circuit, and passing water to be heated through the condenser heat exchanger.

20. The method as set forth in claim 19 wherein the air is passed through the enclosure by convection, including the step of drawing air over the evaporator and compresser and out of the enclosure past the condenser.

21. The method as set forth in claim 19 and further including the step of drawing the air into the enclosure over the evaporator by means of a fan blowing air out of the enclosure past the condenser.

22. The method as set forth in claim 19 and further including the step of insulating the condenser heat exchanger.

23. The method as set forth in claim 19 and further including the step of pumping the water through the heat exchanger condenser.

24. The method as set forth in claim 19 and further including the step of passing the water through the heat exchanger by a thermal siphon principal.

25. The method as set forth in claim 19 and further including the step of selectively reducing the temperature of the evaporator below the dew point of the ambient air.

26. The method as set forth in claim 25 wherein the step of selectively reducing the temperature includes the step of increasing the air flow past the evaporator.

27. The method as set forth in claim 25 wherein the step of selectively reducing the temperature includes the step of increasing the flow of refrigerant into the evaporator.

28. Dehumidifier water heater structure comprising a compresser, combined condenser heat exchanger, expansion device and evaporator connected in series in a heat pump circuit, means for circulating air to be dehumidified around the evaporator to cause the moisture in the air to be dehumidified to condense on the evaporator including an outer cylindrical enclosure having a plurality of air openings therein, a top and bottom closure and a stack positioned centrally of the top closure, wherein the compresser is positioned centrally of the closure and the condenser heat exchanger is positioned in the stack whereby air entering the enclosure heated by the compresser is passed outwardly through the stack vertically thereof, and means operably associated with the combined condenser heat exchanger for circulating material to be heated through the condenser heat exchanger to transfer heat from the condenser heat exchanger into the material to be heated.

29. Structure as set forth in claim 28 and further including a fan positioned within the enclosure for passing air out of the enclosure through the stack.

30. Structure as set forth in claim 29 wherein the condenser heat exchanger is located within the stack and insulation is provided surrounding the heat exchanger.

31. Structure as set forth in claim 30 and further including pump means for pumping material to be heated through the heat exchanger.

32. Dehumidifier water heater structure comprising a compresser, combined condenser heat exchanger, expansion device and evaportor connected in series in a heat pump circuit, means for circulating air to be dehumidified around the evaporator to cause the moisture in the air to be dehumidified to condense on the evaporator, means operably associated with the combined condenser heat exchanger for circulating material to be heated through the condenser heat exchanger to transfer heat from the condenser heat exchanger into the material to be heated, and means for selectively raising the temperature of the evaporator above the dew point of the ambient air comprising means for increasing air flow past the evaporator.

33. Dehumidifier water heater structure comprising a compresser, combined condenser heat exchanger, expansion device and evaporator connected in series in a heat pump circuit, means for circulating air to be dehumidified around the evaporator to cause the moisture in the air to be dehumidified to condense on the evaporator, means operably associated with the combined condenser heat exchanger for circulating material to be heated through the condenser heat exchanger to transfer heat from the condenser heat exchanger into the material to be heated, and means for selectively raising the temperature of the evaporator above the dew point of the ambient air comprising means for increasing the flow of refrigerant therethrough.

34. Dehumidifier water heater structure comprising an outer enclosure including a cylindrical casing having a plurality of air openings therein, a bottom closure over the lower end of the outer casing having an opening therethrough through which condensation may be drained, a top closure over the upper end of the outer casing, a cylindrical stack extending axially through the top closure, a compresser positioned substantially centrally in the cylindrical casing beneath the stack, a condenser heat exchanger positioned in the stack including a inner substantially straight pipe extending axially of the stack and an outer helically wound coil in intimate heat transfer relation to the straight pipe, means connecting the output of the compresser to the top of the helically wound coil of the condenser heat exchanger, an expansion device connected to the bottom of the helically wound coil of the condenser heat exchanger, a large diameter helically wound evaporator coil within the cylindrical casing surrounding the compresser, the bottom of which is connect to the expansion device and the top of which is connected to the compresser to complete a heat pump circuit through the compresser, helical coil of the condenser heat exchanger, expansion device and evaporator and a change of phase change refrigerant in the heat pump circuit, means for connecting a water storage tank to the straight pipe in the condenser heat exchanger for passing water to be heated through the straight pipe, and a fan positioned within the outer enclosure for passing air out of the enclosure through the stack.

35. Structure as set forth in claim 34 wherein insulation is provided around the condenser heat exchanger.

36. The method of dehumidifying air and heating water comprising passing air to be dehumidified into an enclosure including the evaporator of a heat pump circuit to condense the moisture in the air on the evaporator, passing water to be heated through a condenser heat exchanger in the heat pump circuit and selectively reducing the temperature of the evaporator below the dew point of the ambulant air.

37. The method as set forth in claim 36 wherein the step of selectively reducing the temperature includes the step of increasing the air flow past the evaporator.

38. The method as set forth in claim 36 wherein the step of selectively reducing the temperature includes the step of increasing the flow of refrigerant in the evaporator.

* * * * *